US007632077B2

(12) United States Patent
Tagami

(10) Patent No.: US 7,632,077 B2
(45) Date of Patent: Dec. 15, 2009

(54) INCLINED PLATE-TYPE COMPRESSORS AND AIR CONDITIONING SYSTEMS INCLUDING SUCH COMPRESSORS

(75) Inventor: Shinji Tagami, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 592 days.

(21) Appl. No.: 11/122,001

(22) Filed: May 5, 2005

(65) Prior Publication Data

US 2005/0249608 A1 Nov. 10, 2005

(30) Foreign Application Priority Data

May 10, 2004 (JP) ..... 2004/139280

(51) Int. Cl.
*F04B 1/12* (2006.01)

(52) U.S. Cl. ..... 417/269; 417/571; 285/379

(58) Field of Classification Search ..... 417/269, 417/560, 569, 571; 137/512.1; 285/379; 277/593–595, 598, 654, 639, 641, 645
See application file for complete search history.

(56) References Cited

U.S. PATENT DOCUMENTS 2,910,209 A * 10/1959 Nelson ..... 220/378
3,643,965 A * 2/1972 Nicholson ..... 277/645
4,061,443 A * 12/1977 Black et al. ..... 417/222.1
4,360,321 A * 11/1982 Copp et al. ..... 417/269
4,886,424 A * 12/1989 Ikeda et al. ..... 417/269
4,911,614 A * 3/1990 Kawai et al. ..... 417/269
5,066,027 A * 11/1991 Edlund ..... 277/556
5,120,078 A * 6/1992 Udagawa ..... 277/591
5,226,796 A * 7/1993 Okamoto et al. ..... 417/571
5,533,870 A * 7/1996 Takenaka et al. ..... 417/269
6,022,199 A * 2/2000 Yoshii et al. ..... 417/269
6,186,514 B1 * 2/2001 Ikeda et al. ..... 277/594
6,264,207 B1 * 7/2001 Krestel ..... 277/645
6,382,927 B1 * 5/2002 Sonobe et al. ..... 417/269
6,402,483 B1 * 6/2002 Kawamura et al. ..... 417/269
6,428,016 B1 * 8/2002 Miyaoh ..... 277/593
6,695,357 B2 * 2/2004 Schenk et al. ..... 285/355

* cited by examiner

*Primary Examiner*—Devon C Kramer
*Assistant Examiner*—Dnyanesh Kasture
(74) *Attorney, Agent, or Firm*—Baker Botts L.L.P.

(57) ABSTRACT

An inclined plate-type compressor includes a cylinder head, a discharge chamber having an annular shape and disposed along an outer circumferential portion of the cylinder head, a suction chamber disposed at a central portion of the cylinder head, a valve plate including discharge ports, and a discharge valve including reed valve-type valve bodies disposed in the discharge chamber. Each valve body opens and closes a corresponding discharge port, and each valve body extends in a circumferential direction of the discharge chamber and is oriented along the annular shape of the discharge chamber. Because each valve body extends in the circumferential direction of the discharge chamber, the length of each valve body may be increased as compared with that in known compressors, wherein the valve body extends in the radial direction over the width of the annular discharge chamber. Consequently, stress, which is generated at a root portion of each valve body when the valve body is opened or closed, may be reduced.

10 Claims, 5 Drawing Sheets

INCLINED PLATE-TYPE COMPRESSORS AND AIR CONDITIONING SYSTEMS INCLUDING SUCH COMPRESSORS

BACKGROUND OF THE INVENTION

1. Field of the Invention

The present invention relates to inclined plate-type compressors. Further, the invention relates to air conditioning systems, in particular, air conditioning systems for vehicles, which comprise such inclined plate-type compressors.

2. Description of Related Art

An inclined plate-type compressor is described in Japanese Patent Application Publication No. JP-A-2002-250279, wherein a discharge chamber having an annular shape is disposed along an outer circumferential portion of a cylinder head, a suction chamber is formed at a central portion of the cylinder head, and a discharge valve having reed valve-type valve bodies disposed on the discharge chamber for opening and closing discharge ports is formed in a valve plate. In this inclined plate-type compressor, each of the valve bodies of the discharge valve extends in the radial direction of the discharge chamber, and the root portions of the valve bodies are press-fitted to the valve plate by an end surface of a partition wall between the discharge chamber and the suction chamber.

In such an inclined plate-type compressor, because each of the valve bodies of the discharge valve extends in the radial direction of the discharge chamber which has a relatively small radial width, the length of each valve body is constrained by the width of the discharge chamber. In addition, a significant and potentially damaging stress may be generated at a root portion of the valve body when the valve body is opened or closed.

SUMMARY OF THE INVENTION

Accordingly, a need has arisen for an inclined plate-type compressor wherein a discharge chamber having an annular shape is disposed along an outer circumferential portion of a cylinder head, a suction chamber is formed at a central portion of the cylinder head, and a discharge valve having reed valve-type valve bodies is disposed on the discharge chamber for opening and closing discharge ports formed in a valve plate, in which stress, generated at a root portion of each valve body when the valve body is opened or closed, may be reduced as compared with that in the above-described, known inclined plate-type compressors.

To satisfy the foregoing need and other objects, an inclined plate-type compressor according to the present invention, comprises a cylinder head, a discharge chamber having an annular shape and disposed along an outer circumferential portion of the cylinder head, a suction chamber formed at a central portion of the cylinder head, a valve plate comprising a plurality of discharge ports in communication with the discharge chamber, and a discharge valve comprising a plurality of reed valve-type valve bodies disposed in the discharge chamber. Each of the valve bodies opens and closes a corresponding one of the discharge ports, and each of the valve bodies extends in a circumferential direction of the discharge chamber and oriented along the annular shape of the discharge chamber. Because each valve body of the discharge valve extends in the circumferential direction of the annular discharge chamber, the length of each valve body may be increased as compared with that in the above-described known inclined plate-type compressors wherein the valve body extends in the radial direction of the annular discharge chamber. Therefore, in the present invention, a stress, generated at a root portion of each valve body when the valve body is opened or closed, may be reduced.

An air conditioning system, according to the present invention, comprises an inclined plate-type compressor. The compressor comprises a cylinder head, a discharge chamber having an annular shape and disposed along an outer circumferential portion of the cylinder head, a suction chamber formed at a central portion of the cylinder head, a valve plate comprising a plurality of discharge ports in communication with the discharge chamber, and a discharge valve comprising a plurality of reed valve-type valve bodies disposed in the discharge chamber. Each of the valve bodies opens and closes a corresponding one of the discharge ports, and each of the valve bodies extends in a circumferential direction of the discharge chamber and oriented along the annular shape of the discharge chamber. Because each valve body of the discharge valve extends in the circumferential direction of the annular discharge chamber, the length of each valve body may be increased as compared with that in the above-described known inclined plate-type compressors wherein the valve body extends in the radial direction of the annular discharge chamber. Therefore, in the present invention, a stress, generated at a root portion of each valve body when the valve body is opened or closed, may be reduced.

In a preferred embodiment of the present invention, a head gasket is interposed between the valve plate and the cylinder head, and a retainer, which regulates an opening degree or extent of a corresponding valve body, is formed integrally with the head gasket to oppose the corresponding valve body. Further, portions of the retainer at either side of the retainer opposite a tip portion of the valve body and a retainer root portion of the retainer opposite a valve body root portion of the valve body remain attached to the head gasket, and head gasket portions adjacent to either side of the retainer portion are secured, e.g., press-fitted, to the valve plate by a first end surface of a partition wall between the discharge chamber and the suction chamber and a second end surface of an outer circumferential wall of the cylinder head. Moreover, the retainer root portion and the valve body root portion are secured, e.g., press-fitted to the valve plate by a seat surface of a fastening bolt threaded portion formed on the outer circumferential wall of the cylinder head. In such a structure, the valve body root portion and the retainer may be readily secured to the valve plate.

In another preferred embodiment of the present invention, a head stepped portion and a gasket stepped portion for receiving each valve body are disposed on the second end surface of the outer circumferential wall of the cylinder head and an outer circumferential portion of the head gasket, respectively. A first portion of the outer circumferential portion of the head gasket, which is positioned inside of the gasket stepped portion, and an outer circumferential portion of the discharge valve are secured, e.g., press-fitted, to the valve plate by a portion of the second end surface of the outer circumferential wall of the cylinder head, which is positioned inside of the head stepped portion. A second portion of the outer circumferential portion of the head gasket, which is positioned outside of the gasket stepped portion is secured, e.g., press-fitted, to the valve plate by a portion of the second end surface of the outer circumferential wall of the cylinder head, which is positioned outside of the head stepped portion.

In this structure, the outer circumferential portion of the discharge valve and the outer circumferential portion of the head gasket may be readily secured to the valve plate. Because a double annular seal is formed by the portions of the outer circumferential portion of the head gasket positioned inside and outside of the gasket stepped portion, the head gasket has increased sealing performance.

In yet another preferred embodiment of the present invention, a bead is formed on the portion of the outer circumferential portion of the head gasket, which is positioned outside of the gasket stepped portion, and a compression ratio of the bead, when the portion of the outer circumferential portion of the head gasket, which is positioned outside of the gasket stepped portion, is secured, e.g., press-fitted, to the valve plate by the portion of the second end surface of the outer circumferential wall of the cylinder head, which is positioned outside of the head stepped portion, is less than 100%.

In this structure, by maintaining the compression ratio of the bead at a value less than 100%, the seal achieved by the portion of the outer circumferential portion of the head gasket, which is positioned outside of the gasket stepped portion, becomes a combination of a plane seal and a line seal. Although a plane seal has an increased degree of sealability, if there are scratches or other imperfections on the sealing surface, the sealability tends to deteriorate markedly, and the seal lacks stability. On the other hand, although a line seal has a lower degree of sealability than the plane seal, even if there are scratches or other imperfections on the sealing surface, the sealability does not decrease as much, and the seal is stable. Therefore, by combining such a plane seal and line seal, an increased sealing performance and a stable sealing may be achieved.

In still another preferred embodiment of the present invention, the inclined plate-type compressor has a communication passage for placing a fine annular space, formed between the head stepped portion, an outer surface of the discharge valve, and the valve plate, in communication with a lower-pressure region of the compressor. In this structure, because the pressure in the fine annular space is reduced, the sealability due to the portion of the outer circumferential portion of the head gasket, which is positioned outside of the gasket stepped portion, is increased.

Thus, in the inclined plate-type compressor according to the present invention, by extending each valve body of the discharge valve in the circumferential direction of the discharge chamber, the length of each valve body may be increased as compared with that in the above-described known inclined plate-type compressors, wherein the valve body extends in the radial direction over the width of the annular discharge chamber, and a stress, which is generated at the root portion of each valve body when the valve body is opened or closed, may be reduced remarkably. Further, in the preferred embodiments of the present invention, an increased degree of sealability may be readily achieved at a portion including the head gasket.

Further objects, features, and advantages of the present invention will be understood from the following detailed description of preferred embodiments of the present invention with reference to the accompanying figures.

BRIEF DESCRIPTION OF THE DRAWINGS

Embodiments of the invention now are described with reference to the accompanying figures, which are given by way of example only, and are not intended to limit the present invention.

FIG. 5A is a perspective view of the components; FIG. 5B is a cross-sectional view along B-B line of FIG. 5A; FIG. 5C is a cross-sectional view along C-C line of FIG. 5A; and FIG. 5D is an enlarged, partial cross-sectional view of the portion depicted in FIG. 5B.

DETAILED DESCRIPTION OF PREFERRED EMBODIMENTS

Figure 1:
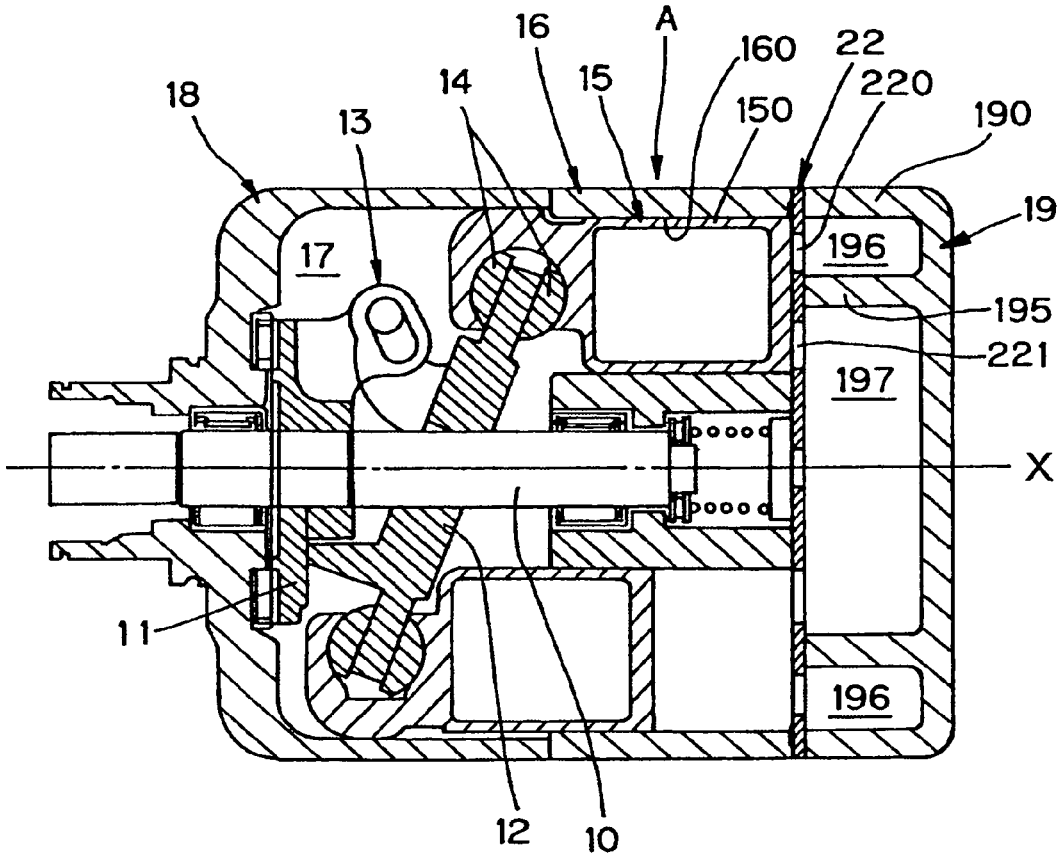
FIG. 1 is a cross-sectional view of an inclined plate-type compressor according to an embodiment of the present invention.

FIG. 1 depicts an inclined plate-type compressor according to an embodiment of the present invention. Inclined plate-type compressor A has a drive shaft 10, a rotor 11 which is secured to drive shaft 10, and an inclined plate 12 which is supported by drive shaft 10, such that the inclination angle of inclined plate 12 may be altered. In particular, inclined plate 12 is connected to rotor 11 via a link mechanism 13 adapted to allow the inclination angle of inclined plate 12 to be altered, and rotated synchronously with rotor 11 and, ultimately, with drive shaft 10.

Piston 15 engages inclined plate 12 via a pair of shoes 14 which slide on the outer circumferential portion of inclined plate 12. Piston head 150 of piston 15 is inserted into cylinder bore 160 formed in cylindrical cylinder block 16. A plurality of cylinder bores 160 are disposed around central axis X at a predetermined interval, and each piston head 150 of pistons 15 is inserted into one of cylinder bores 160.

A cup-like, cylindrical front housing 18 defines a crank chamber 17, in which drive shaft 10, rotor 11, and inclined plate 12 are disposed. Front housing 18 faces one surface of cylinder block 16. A cylinder head 19 faces the other surface of cylinder block 16. Cylinder head 19 has an outer circumferential wall 190, an inner circumferential wall 195, an annular discharge chamber 196, which is formed between outer circumferential wall 190 and inner circumferential wall 195, and a circular suction chamber 197, which is formed inside of inner circumferential wall 195 at a central portion of cylinder head 19. Suction chamber 197 and discharge chamber 196 are distinguished, in part, by their cross-sectional shapes. Discharge chamber 196 communicates with cylinder bore 160 via a discharge port, and suction chamber 197 communicates with cylinder bore 160 via a suction port. Each of the discharge ports and the suction ports is in communication with other known components of an air conditioning system, such as a condenser and an evaporator (not shown).

A disc-like, valve plate 22 is interposed between cylinder block 16 and cylinder head 19. Valve plate 22 has discharge ports 220 and suction ports 221 aligned and in communication with corresponding cylinder bores 160. Each pair of discharge ports 220 and suction ports 221 is arranged along a line extending radially from the center of valve plate 22.

As depicted in FIGS. 2, 3 and 4A-4G, a disc-like, discharge valve 23 and a disc-like, head gasket 24 are disposed between valve plate 22 and cylinder head 19. Reed valve-type valve bodies 230 for opening and closing respective discharge ports 220 are disposed on the outer circumferential portion of discharge valve 23 integrally with discharge valve 23. Each valve body 230 extends along the outer circumference of discharge valve 23.

A retainer 240 for regulating the degree of opening of each valve body 230 is formed on head gasket 24 integrally with head gasket 24 so as to oppose each valve body 230. Retainer 240 is formed by cutting head gasket 24 and raising the cut portion. Both side portions 241 of retainer 240 opposite a tip portion of the corresponding valve body 230 and a retainer root portion 242 of retainer 240 opposite the valve body root portion of the corresponding valve body 230 remain attached to head gasket 24. In head gasket 24, a central recessed portion 243 formed with retainers 240, a flange-like, outer circumferential portion 244, and a gasket stepped portion for receiving each valve body 230, forming a boundary between central recessed portion 243 and outer circumferential portion 244, are formed. A first bead 245 extending around the circumference is disposed on outer circumferential portion 244.

On the end surface of outer circumferential wall 190 of cylinder head 19, an inner recessed portion 191 opposite the outer circumferential portion of central recessed portion 243 of head gasket 24 and the outer circumferential portion of discharge valve 23, seat surfaces 192 of the threaded portions of this fastening bolt extend radially inward from inner recessed portion 191, an outer circumferential portion 193 of wall 190 opposite outer circumferential portion 244 of head gasket 24, and a head stepped portion 194 for receiving the valve bodies and forming a boundary between outer circumferential portion 193 and inner recessed portion 191, are formed. The end surface of inner circumferential wall 195 of cylinder head 19 is formed flush relative to inner recessed portion 191 and seat surfaces 192 of fastening bolt, threaded portions at the end surface of the outer circumferential wall 190 of cylinder head 19.

Figure 2:
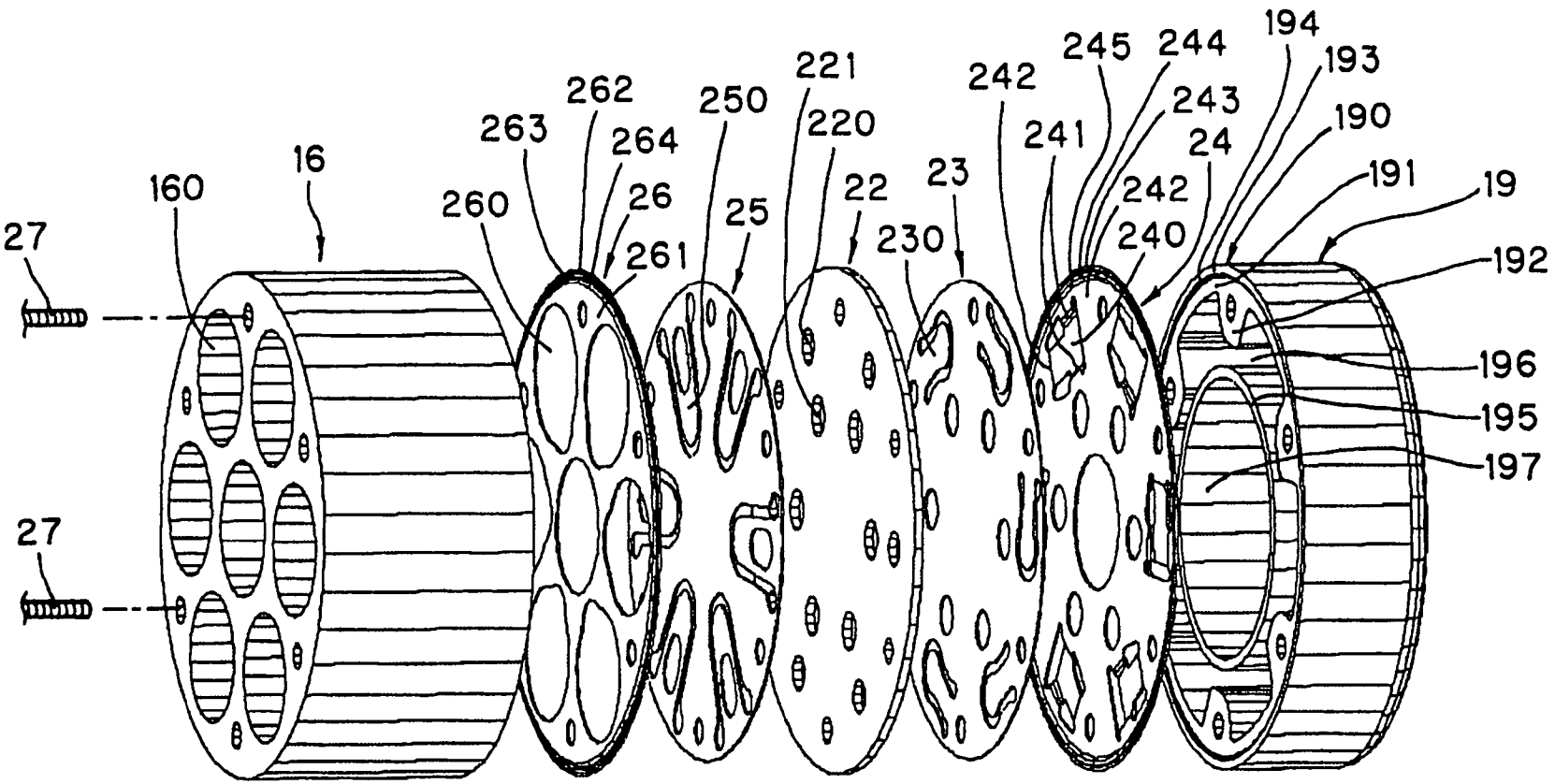
FIG. 2 is an exploded perspective view of components of the inclined plate-type compressor depicted in FIG. 1.
Figure 3:
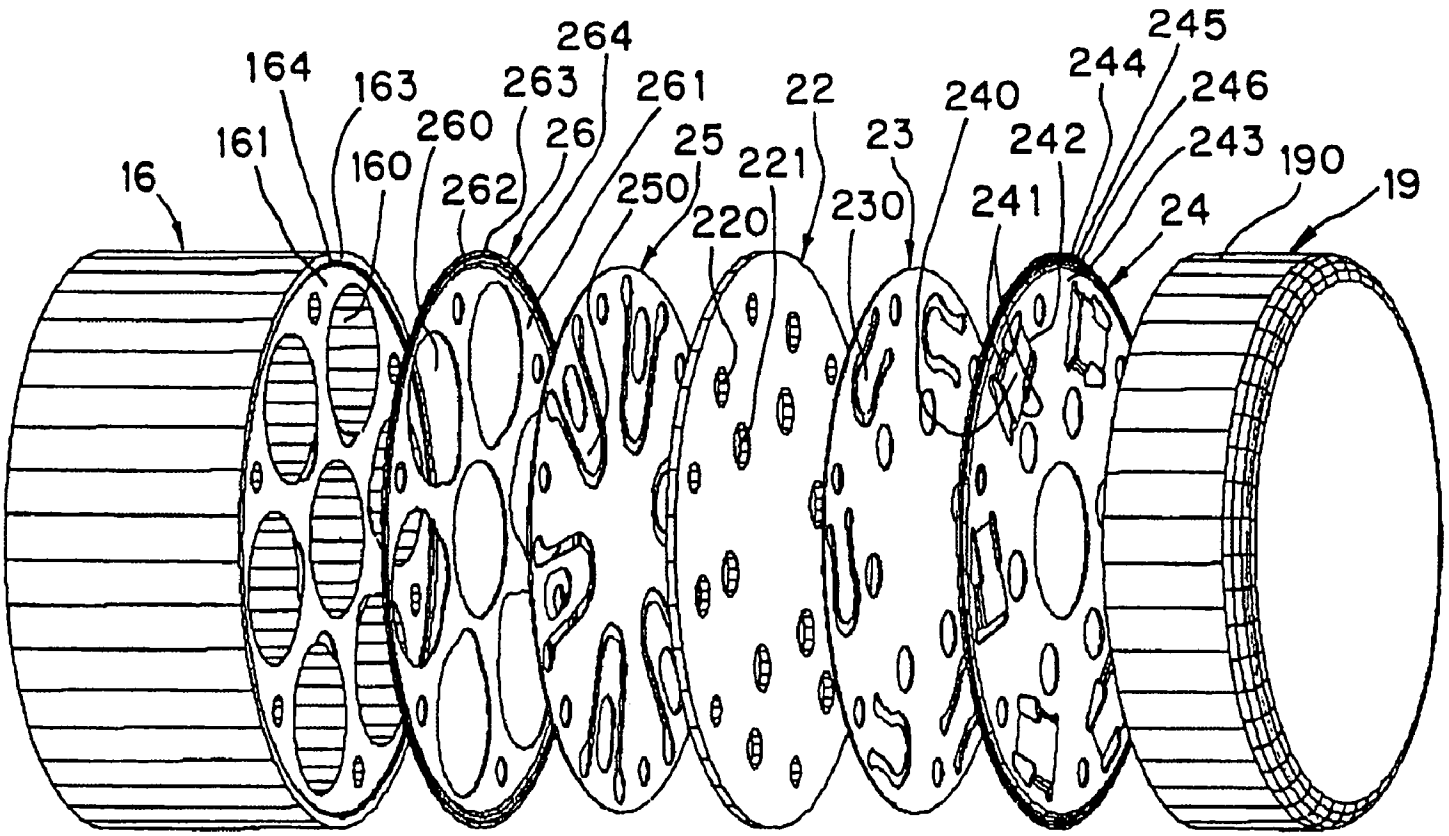
FIG. 3 is an exploded perspective view of components of the inclined plate-type compressor depicted in FIG. 1, as viewed from an angle different from that of FIG. 2.
Figure 4A:
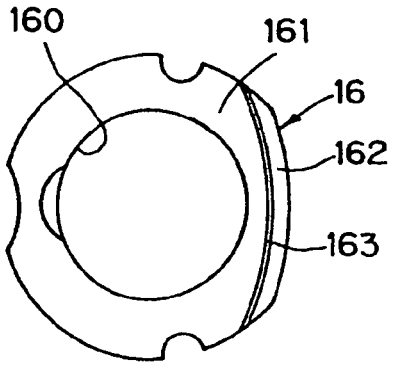
FIGS. 4A-4G are partial, plan views of components of the inclined plate-type compressor depicted in FIG. 1.
Figure 4B:
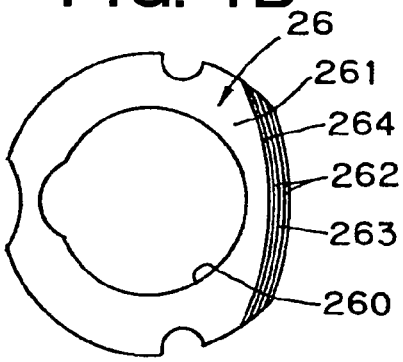
Figure 4C:
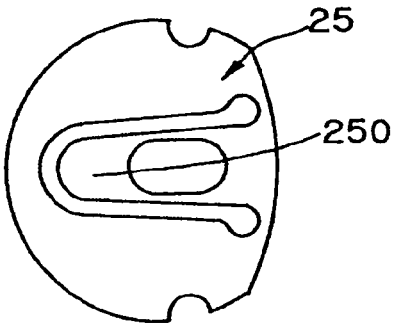
Figure 4D:
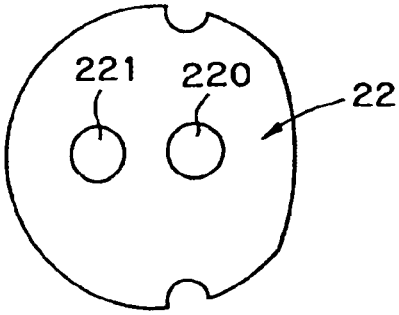
Figure 4E:
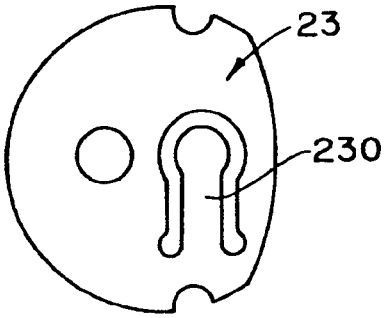
Figure 4F:
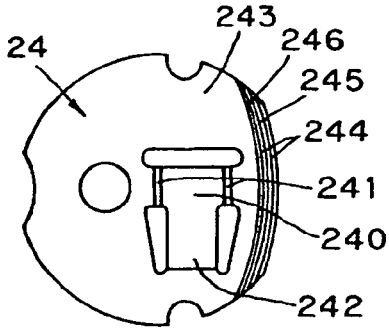
Figure 4G:
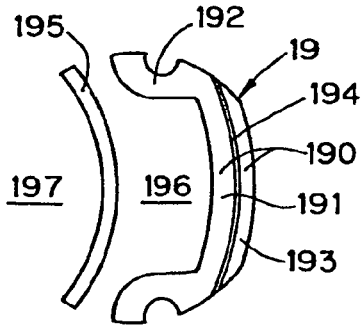

As depicted in FIGS. 2-4, a disc-like, suction valve 25 and a disc-like, cylinder gasket 26 are disposed between valve plate 22 and cylinder block 16. Reed valve-type valve bodies 250 for opening and closing suction ports 220 are formed integrally with suction valve 25. Each valve body 250 extends radially inwardly from the outer edge portion of suction valve 25. Openings 260 conforming to corresponding cylinder bores 160 are formed through cylinder gasket 26. A central recessed portion 261 formed with openings 260, a flange-like outer circumferential portion 262, and a stepped portion 264 for receiving the suction valve bodies and defining the boundary between central recessed portion 261 and outer circumferential portion 262, are formed through cylinder gasket 26. A second bead 263 extending in the circumferential direction is disposed on outer circumferential portion 262.

On the end surface of the cylinder head-side of cylinder block 16, a central recessed portion 161 is formed opposite to central recessed portion 261 of cylinder gasket 26, and an outer circumferential portion 162 is formed opposite outer circumferential portion 262 of cylinder gasket 26. A stepped portion 163 for receiving the suction valve bodies defines the boundary between central recessed portion 161 and outer circumferential portion 162.

Cylinder block 16, cylinder gasket 26, suction valve 25, valve plate 22, discharge valve 23, head gasket 24, and cylinder head 19 are fastened together by through bolts 27.

Figure 5C:
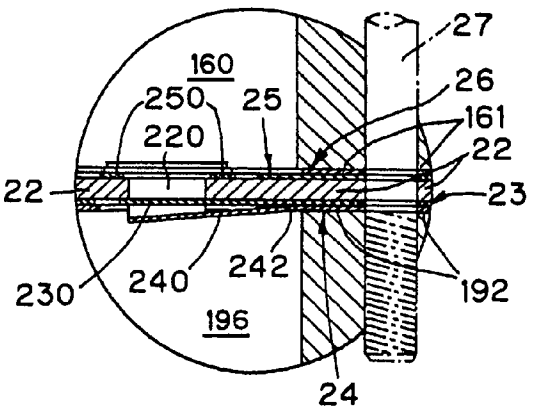
FIGS. 5A-5D depict the relationship between a cylinder block, a cylinder gasket, a suction valve, a valve plate, a discharge valve, a head gasket and a cylinder head, when assembled.
Figure 5D:
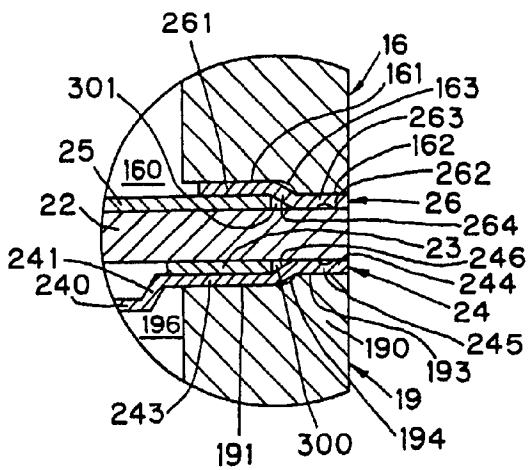
Figure 5A:
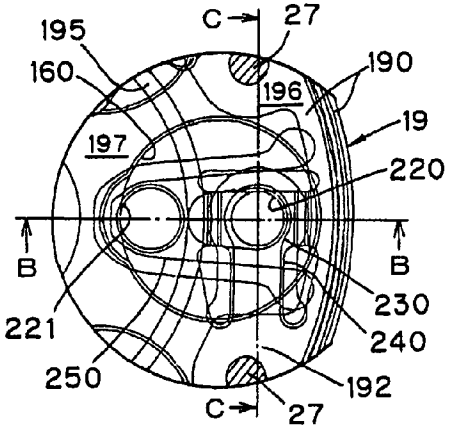
Figure 5B:
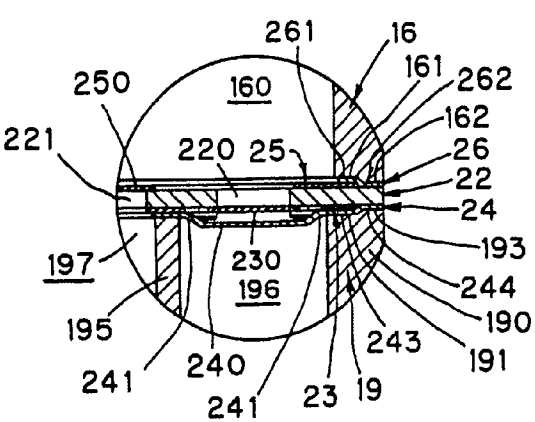

When the above-described parts are fastened together by through bolts 27, as depicted in FIG. 5B, discharge valve 23 is housed in central recessed portion 243 of head gasket 24, and the outer circumferential portion of central recessed portion 243 of head gasket 24 is housed in inner recessed portion 191 on the end surface of outer circumferential wall 190 of cylinder head 19. Valve bodies 230 of discharge valve 23 and retainers 240 are housed in discharge chamber 196. As depicted in FIG. 5A, each valve body 230 extends in the circumferential direction of discharge chamber 196 and along the annular shape of discharge chamber 196.

Further, when the above-described components are fastened together by through bolts 27, as depicted in FIG. 5B, the portions of head gasket 24 adjacent to either side 241 of retainer 240 opposite the tip portion of valve body 230 are press-fitted to valve plate 22 together with discharge valve 23 by inner recessed portion 191 on the end surface of outer circumferential wall 190 of cylinder head 19 and the end surface of inner circumferential wall 195. As depicted in FIG. 5C, the root portion of valve body 230 of the discharge valve 23 and root portion 242 of retainer 240 are press-fitted to valve plate 22 by fastening bolt, threaded portion seat surface 192 formed on the end surface of outer circumferential wall 190 of cylinder head 19.

When the above-described components are fastened together by through bolts 27, as depicted in FIG. 5D, the portion adjacent to stepped portion 246 at the outer circumferential portion of central recessed portion 243 of head gasket 24 and the outer circumferential portion of discharge valve 23 are press-fitted to valve plate 22 by inner recessed portion 191 on the end surface of outer circumferential wall 190 of cylinder head 19. Outer circumferential portion 244 of head gasket 24 is press-fitted to valve plate 22 by outer circumferential portion 193 on the end surface of outer circumferential wall 190 of the cylinder head 19.

Moreover, when the above-described components are fastened together by through bolts 27, as depicted in FIG. 5D, the compression ratio of bead 245 formed on outer circumferential portion 244 of head gasket 24 is less than 100%. The state in which the protrusion of the bead is pressed and compressed completely is referred to as a compression ratio of 100%, and the state in which the protrusion of the bead is not pressed and compressed at all is referred to as a compression ratio of 0%.

Further, when the above-described components are fastened together by through bolts 27, as depicted in FIG. 5D, a fine, i.e., slender, thin, or small-sized, annular space 300 is formed between gasket stepped portion 246 formed on outer circumferential portion 243 of head gasket 24, the outer circumferential surface of discharge valve 23, and valve plate 22. Fine annular space 300 communicates with a lower pressure region of inclined plate-type compressor A, such as the external suction inlet 220, suction chamber 197, and crank chamber 17, via a communication passage (not shown).

When the above-described components are fastened together by through bolts 27, as depicted in FIG. 5B, suction valve 25 is housed in central recessed portion 261 of cylinder gasket 26, and the outer circumferential portion of central recessed portion 261 of cylinder gasket 26 is housed in central recessed portion 161 formed on the end surface of cylinder block 16. As depicted in FIG. 5A, valve body 250 extends from the outer edge portion of disc-like suction valve 25 in a radially inward direction.

Moreover, when the above-described components are fastened together by through bolts 27, as depicted in FIG. 5D, the portion adjacent to stepped portion 264 on the outer circumferential portion of central recessed portion 261 of cylinder gasket 26 and the outer circumferential portion of suction valve 25 are press-fitted to valve plate 22 by inner recessed portion 161 on the end surface of cylinder block 16. Outer circumferential portion 262 of cylinder gasket 26 is press-fitted to valve plate 22 by outer circumferential portion 162 on the end surface of cylinder block 16.

In addition, when the above-described components are fastened together by through bolts 27, as depicted in FIG. 5D, the compression ratio of bead 263 formed on outer circumferential portion 262 of cylinder gasket 26 is less than 100%.

The state in which the protrusion of the bead is pressed and compressed completely is referred to as a compression ratio of 100%, and the state in which the protrusion of the bead is not pressed and compressed at all is referred to as a compression ratio of 0%.

When the above-described components are fastened together by through bolts 27, as depicted in FIG. 5D, a fine annular space 301 is formed by stepped portion 264 formed between outer circumferential portion 262 of cylinder gasket 26, the outer circumferential surface of suction valve 25, and valve plate 22. Fine annular space 301 communicates with a lower pressure region of inclined plate-type compressor A, such as external suction inlet, suction chamber 19*d*, crank chamber 17, via a communication passage (not shown).

In such variable displacement, inclined plate-type compressor A, the rotation of drive shaft 10 is transmitted to inclined plate 12 via rotor 11 and link mechanism 13. The reciprocating movement of the outer circumferential portion of inclined plate 12 in the axial direction parallel to drive shaft 10, which is ascribed to the rotation of inclined plate 12, is transmitted to pistons 15 via shoes 14. Piston head 150 of each piston 15 moves reciprocally in cylinder bore 160. Refrigerant gas, which is circulated from an external refrigeration circuit and flows into cylinder bore 160 through the external suction inlet, suction chamber 197, suction port 221, and valve body 250 of suction valve 25, is compressed by piston 15. The compressed refrigerant gas is discharged to discharge chamber 196 through discharge port 220 and valve body 230 of discharge valve 23. The refrigerant gas discharged into discharge chamber 196 is circulated to the external refrigeration circuit through the external discharge outlet.

In variable displacement inclined plate-type compressor A, as depicted in FIG. 5A, because valve body 230 is extended in the circumferential direction of discharge chamber 196 and oriented along the annular shape of discharge chamber 196, the length of the valve body 230 is increased as compared with that in above-described, known, inclined plate-type compressors wherein the valve body extends in the radial direction across the width of the annular discharge chamber, and stress at the root portion of valve body 230, generated when the valve body 230 is opened or closed, may be reduced significantly.

Further, in this inclined plate-type compressor A, because the portions of head gasket 24 adjacent to either side 241 of retainer 24 facing the tip portion of valve body 230 is press-fitted to valve plate 22 together with discharge valve 23 by inner recessed portion 191 on the end surface of outer circumferential wall 190 of cylinder head 19 and the end surface of inner circumferential wall 195, and as depicted in FIG. 5C, the root portion of valve body 230 of discharge valve 23 and root portion 242 of retainer 240 are press-fitted to valve plate 22 by seat surface 192 of the fastening bolt, threaded portion formed on the end surface of outer circumferential wall 190 of cylinder head 19, the securing of the root portion of valve body 230 of discharge valve 23 and retainer 240 to valve plate 22 may be facilitated.

Moreover, in this inclined plate-type compressor A, because the portion adjacent to gasket stepped portion 246 on the outer circumferential portion of central recessed portion 243 of head gasket 24 and the outer circumferential portion of discharge valve 23 are press-fitted to valve plate 22 by inner recessed portion 191 on the end surface of outer circumferential wall 190 of cylinder head 19, and outer circumferential portion 244 of head gasket 24 is press-fitted to valve plate 22 by outer circumferential portion 193 on the end surface of outer circumferential wall 190 of cylinder head 19, the securing of the outer circumferential portion of discharge valve 23 and outer circumferential portion 244 of head gasket 24 to valve plate 22 may be facilitated. Because a double annular seal is formed by the portion adjacent to gasket stepped portion 246 on the outer circumferential portion of central recessed portion 243 of head gasket 24 and head gasket outer circumferential portion 244, the sealability of head gasket 24 may be increased. In the securing portion of the outer circumferential portion of cylinder gasket 26 and the outer circumferential portion of suction valve 25 to valve plate 22, because a similar structure is employed, an advantage similar to the above-described advantage may be obtained.

In addition, in this inclined plate-type compressor A, because the compression ratio of bead 245 formed on outer circumferential portion 244 of head gasket 24 is less than 100%, a combination of a plane seal and a line seal may be achieved for the seal due to head gasket outer circumferential portion 244. As described above, although a plane seal has an increased degree of sealability, if there are scratches or other imperfections on the sealing surface, the sealability tends to decrease significantly, and the seal lacks stability. On the other hand, although a line seal has a lower degree of sealability than the plane seal, even if there are scratches or other imperfections on the sealing surface, the sealability does not decrease so much, and the seal is stable. Therefore, by the above-described combination of the plane seal and the line seal, an increased sealing performance and a stable sealing may be achieved. In the securing portion of outer circumferential portion 262 of cylinder gasket 26 to valve plate 22, because a similar structure is employed, an advantage similar to the above-described advantage may be obtained.

In this inclined plate-type compressor A, because fine annular space 300, formed between gasket stepped portion 246 on outer circumferential portion 244 of head gasket 24, the outer surface of discharge valve 23, and valve plate 22, communicates with the lower pressure region of inclined plate-type compressor A such as the external suction inlet, suction chamber 197, crank chamber 17, via a communication passage, the pressure in fine annular space 300 may be reduced. The sealability due to outer circumferential portion 244 of head gasket 24 also may be increased. In the securing portion of outer circumferential portion 262 of cylinder gasket 26 and the outer circumferential portion of suction valve 25, because a similar structure is employed, an advantage similar to the above-described advantage may be obtained.

The present invention may be applied broadly to an inclined plate-type compressor including a wobble plate-type compressor.

Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. An inclined plate-type compressor comprising:

a cylinder head;

a discharge chamber having an annular shape and disposed along an outer circumferential portion of said cylinder head;

a suction chamber formed at a central portion of said cylinder head;

a valve plate comprising a plurality of discharge ports in communication with said discharge chamber;

a discharge valve comprising a plurality of reed valve-type valve bodies disposed in said discharge chamber, each of said valve bodies opening and closing a corresponding one of said discharge ports, each of said valve bodies extending in a circumferential direction of said discharge chamber and oriented along said annular shape of said discharge chamber;

a retainer, which regulates an opening degree of a corresponding one of said valve bodies, wherein portions of said retainer at either side of said retainer opposite a tip portion of each of said valve bodies and a retainer root portion of said retainer opposite a valve body root portion of each of said valve bodies remain attached to said head gasket;

a head gasket interposed between said valve plate and said cylinder head;

a head stepped portion for receiving each of said valve bodies is disposed on an outer circumferential portion of said head gasket; and a communication passage placing a fine annular space, which is formed between said head stepped portion, an outer surface of said discharge valve, and said valve plate, in communication with a lower pressure region of said inclined plate-type compressor, wherein said retainer root portion and said valve body root portion are secured to said valve plate by a seat surface of a threaded portion of a fastening bolt formed on said outer circumferential wall of said cylinder head, and said seat surface is adjacent to the retainer root portion and valve body root portion, and wherein a line extending from a longitudinal axis of the valve body intersects said seat surface.

2. The inclined plate-type compressor according to claim 1, wherein the retainer is formed integrally with said head gasket to oppose the corresponding one of said valve bodies.

3. The inclined plate-type compressor according to claim 2, wherein head gasket portions adjacent to either side of said retainer portions are secured to said valve plate by a first end surface of a partition wall between said discharge chamber and said suction chamber and a second end surface of an outer circumferential wall of said cylinder head.

4. The inclined plate-type compressor according to claim 3, wherein a gasket stepped portion for receiving each of said valve bodies is disposed on said second end surface of said outer circumferential wall of said cylinder head, and a portion of said outer circumferential portion of said head gasket, which is positioned inside of said gasket stepped portion, and an outer circumferential portion of said discharge valve are secured to said valve plate by a portion of said second end surface of said outer circumferential wall of said cylinder head, which is positioned inside of said head stepped portion, and a portion of said outer circumferential portion of said head gasket, which is positioned outside of said gasket stepped portion, is secured to said valve plate by a portion of said second end surface of said outer circumferential wall of said cylinder head, which is positioned outside of said head stepped portion.

5. The inclined plate-type compressor according to claim 4, wherein a bead is deposed on said portion of said outer circumferential portion of said head gasket, which is positioned outside of said gasket stepped portion, and a compression ratio of said bead, when said portion of said outer circumferential portion of said head gasket, which is positioned outside of said gasket stepped portion, is secured to said valve plate by said portion of said second end surface of said outer circumferential wall of said cylinder head, which is positioned outside of said head stepped portion, is less than 100%.

6. An air conditioning system comprising an inclined plate-type compressor, said compressor comprising:

a cylinder head;

a discharge chamber having an annular shape and disposed along an outer circumferential portion of said cylinder head;

a suction chamber formed at a central portion of said cylinder head;

a valve plate comprising a plurality of discharge ports in communication with said discharge chamber;

a discharge valve comprising a plurality of reed valve-type valve bodies disposed in said discharge chamber, each of said valve bodies opening and closing a corresponding one of said discharge ports, each of said valve bodies extending in a circumferential direction of said discharge chamber and oriented along said annular shape of said discharge chamber;

a retainer, which regulates an opening degree of a corresponding one of said valve bodies, wherein portions of said retainer at either side of said retainer opposite a tip portion of each of said valve bodies and a retainer root portion of said retainer opposite a valve body root portion of each of said valve bodies remain attached to said head gasket;

a head gasket interposed between said valve plate and said cylinder head;

a head stepped portion for receiving each of said valve bodies is disposed on an outer circumferential portion of said head gasket; and a communication passage placing a fine annular space, which is formed between said head stepped portion, an outer surface of said discharge valve, and said valve plate, in communication with a lower pressure region of said inclined plate-type compressor, wherein said retainer root portion and said valve body root portion are secured to said valve plate by a seat surface of a threaded portion of a fasteninit bolt formed on said outer circumferential wall of said cylinder head, and said seat surface is adiacent to the retainer root portion and valve body root portion, and wherein a line extending from a longitudinal axis of the valve body intersects said seat surface.

7. The air conditioning system of claim 6, wherein said inclined plate-type compressor further comprises the retainer formed integrally with said head gasket to oppose the corresponding one of said valve bodies.

8. The air conditioning system of claim 7, wherein said inclined plate-type compressor further comprises head gasket portions adjacent to either side of said retainer portions are secured to said valve plate by a first end surface of a partition wall between said discharge chamber and said suction chamber and a second end surface of an outer circumferential wall of said cylinder head.

9. The air conditioning system of claim 8, wherein said inclined plate-type compressor further comprises a gasket stepped portion for receiving each of said valve bodies is disposed on said second end surface of said outer circumferential wall of said cylinder head, and a portion of said outer circumferential portion of said head gasket, which is positioned inside of said gasket stepped portion, and an outer circumferential portion of said discharge valve are secured to said valve plate by a portion of said second end surface of said outer circumferential wall of said cylinder head, which is positioned inside of said head stepped portion, and a portion of said outer circumferential portion of said head gasket, which is positioned outside of said gasket stepped portion, is secured to said valve plate by a portion of said second end surface of said outer circumferential wall of said cylinder head, which is positioned outside of said head stepped portion.

10. The air conditioning system of claim 9, wherein said inclined plate-type compressor further comprises a bead is deposed on said portion of said outer circumferential portion of said head gasket, which is positioned outside of said gasket stepped portion, and a compression ratio of said bead, when said portion of said outer circumferential portion of said head gasket, which is positioned outside of said gasket stepped portion, is secured to said valve plate by said portion of said second end surface of said outer circumferential wall of said cylinder head, which is positioned outside of said head stepped portion, is less than 100%.

* * * * *

UNITED STATES PATENT AND TRADEMARK OFFICE

CERTIFICATE OF CORRECTION

PATENT NO. : 7,632,077 B2
APPLICATION NO. : 11/122001
DATED : December 15, 2009
INVENTOR(S) : Shinji Tagami It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 966 days.

Signed and Sealed this

Twenty-first Day of December, 2010

David J. Kappos

David J. Kappos
*Director of the United States Patent and Trademark Office*